US006412200B1

(12) United States Patent
Savard

(10) Patent No.: US 6,412,200 B1
(45) Date of Patent: Jul. 2, 2002

(54) RETRACTABLE SIDE WING ASSEMBLY

(76) Inventor: Normand Savard, 1097 rue Normandie, Baie-Comeau QBC (CA), G5C 3S7

( * ) Notice: Subject to any disclaimer, the term of this patent is extended or adjusted under 35 U.S.C. 154(b) by 0 days.

(21) Appl. No.: 09/774,569

(22) Filed: Feb. 1, 2001

Related U.S. Application Data

(60) Provisional application No. 60/180,133, filed on Feb. 3, 2000.

(51) Int. Cl.[7] ..... E01H 5/06
(52) U.S. Cl. ..... 37/281; 37/274; 37/232
(58) Field of Search ..... 37/266, 280, 281, 37/274, 232; 172/810, 811, 817, 815

(56) References Cited

U.S. PATENT DOCUMENTS

| | | | | |
|---|---|---|---|---|
| 2,643,470 A | * | 6/1953 | Kaeser | 37/42 |
| 2,991,566 A | * | 7/1961 | Sumner et al. | 37/42 |
| 3,659,363 A | * | 5/1972 | Snyder | 37/50 |
| 3,883,965 A | * | 5/1975 | Poirier, Sr. et al. | 37/42 R |
| 4,096,652 A | * | 6/1978 | Raines et al. | 37/41 |
| 4,596,081 A | * | 6/1986 | DeBilly et al. | 37/281 |
| 4,794,710 A | * | 1/1989 | Haring | 37/232 |
| 4,969,280 A | * | 11/1990 | Thorneloe | 37/281 |
| 5,437,113 A | | 8/1995 | Jones | |
| 5,603,172 A | | 2/1997 | Maher | |
| 5,638,618 A | | 6/1997 | Niemela et al. | |
| 5,655,318 A | | 8/1997 | Daniels | |
| 5,819,444 A | | 10/1998 | Desmarais | |
| 5,921,010 A | | 7/1999 | Schulte et al. | |
| 6,249,992 B1 | * | 6/2001 | Irving et al. | 37/281 |

FOREIGN PATENT DOCUMENTS

| | | | | |
|---|---|---|---|---|
| WO | 90/05218 | * | 5/1990 | E01H/5/06 |

* cited by examiner

*Primary Examiner*—Thomas B. Will
*Assistant Examiner*—Kristine Markovich

(57) ABSTRACT

A retractable side wing assembly, adapted to be mounted on a side of a road vehicle for clearing snow off the same, includes a scraper having a frontward end pivotally secured to the side of the vehicle and a rearwardly and outwardly extending free end, a retracting member having a first end rotatably secured to a carriage of a shock absorbing device and a second end rotatably secured to the side of the vehicle rearwardly of the scraper, and a fixed part of the shock absorbing device rigidly secured to the scraper in proximity of the frontward end. The shock absorbing device that could also be retrofitted as a kit on an existing side wing assembly includes an absorber member rigidly secured to both the fixed part and the carriage sliding therealong, and allowing for automatic rearward deflection of the scraper pivoting around the frontward end from its standard position to a deflected position when hitting an obstacle. The assembly may also include a hydraulic ram pushing the carriage toward the fixed part whenever activated by an operator, and a resilient roller member freely rotatably mounted on a generally vertical shaft rigidly supported by brackets secured to the free end of the scraper and slightly extending out of the same to take lateral hit instead of the free end from lateral vertical obstacles.

20 Claims, 4 Drawing Sheets

RETRACTABLE SIDE WING ASSEMBLY

This application claims priority from provisional application Ser. No. 60/180,133, filed Feb. 3, 2000.

FIELD OF THE INVENTION

The present invention relates to scrapers mounted on road vehicles such as snow plows, graders and the like, and more particularly, to deflecting retractable side wing assemblies used for increasing the working span of traditional scrapers.

BACKGROUND OF THE INVENTION

It is well known that during winter, in the few hours following a considerable accumulation of snow, an important snow-clearing operation of the road network of the affected area must be put into gears. This operation must be done quickly for economic reasons, and it must also be done safely.

One way of clearing the streets is by adapting a snowplow structure in front of a vehicle. Often, a lateral extension of this structure, or side wing, increases the reach of the area scraped by the snowplow. When the vehicle is not being used for its snowplowing capabilities, the side wing may sometimes be lifted up vertically on the side of the vehicle to reduce its span on the road.

When an obstacle is in the path of the side wing, the driver usually has two choices to avoid it. He may choose to maneuver his vehicle around the obstacle, often by bringing his vehicle to cross dangerously into the next lane, which may also sometimes have the traffic going the opposite way increasing the chances of having a face-to-face hit with another vehicle. Alternatively the driver may, if the option is given to him, use the lifting device to raise upwardly the side wing. By quickly engaging this motion, the driver will lose precious time by slowing down and may temporarily and dangerously hold his steering wheel with only one hand while the other activates the lifting device.

It may also happens that an obstacle such as a railing or a shoulder, for example, in the path of the side wing is not seen on time, or that it may be hidden and not be detected at all by the driver. In such cases, a security shear pin properly installed at the attachment point between the side wing and the vehicle will break upon impact between the obstacle and the side wing. The driver must then lose precious time by stopping his snowplow and get the security pin replaced. In all cases though, important damages may be inflicted upon the side wing and some elements of the structure of the snowplow, reducing its useful lifetime, as well as causing damages on the obstacle itself that often needs to be replaced thus incurring extra-expenses.

Side wing assembly has been disclosed in the prior art in U.S. Pat. No. 4,969,280 issued on Nov. 13, 1990 to D. Thorneloe. In this invention, the damping system is solely located on the pair of parallel arms, hence cannot easily be protected against outside elements, and may not be easily adaptable as a kit to existing side wing blade assembly, where a complete new attachment system would be required.

It shall also be noted that in the case of the latter invention, when the side blade hits an obstacle, the deflection towards the vehicle is minimal, as per the telescopic distance of the first section and the longer section of the parallel arms, as well as the coil spring elongation. Basically, as soon as one of these mechanisms is fully contracted (and because the fluid ram is fully retracted when the blade engages the ground surface), the assembly will tend to upwardly lift the blade, hence stopping the snow removal action. Therefore, this deflection is not planned to be solely within a horizontal plane and keeping on removing the snow. Furthermore, the fact that both front and rear extremities of the damping assembly are pivotally mounted reduces its efficiency and increases the risk of being subject to frequent damages.

OBJECTS OF THE INVENTION

It is a general object of the present invention to provide a deflecting retractable side wing assembly that obviates the above mentioned disadvantages.

Another object of the present invention is to provide a deflecting retractable side wing assembly that is efficient and simple to manufacture.

A further object of the present invention is to provide a deflecting retractable side wing assembly that is easy to operate with and that can be adjustable to resist different shock levels.

Still another object of the present invention is to provide a deflecting retractable side wing assembly that can be installed as a kit on existing side scrapers to make the latter deflecting upon hits with rigid obstacles.

Still a further object of the present invention is to provide a deflecting retractable side wing assembly that is easily integrated with different types of snow plow structures.

Yet another object of the present invention is to provide a deflecting retractable side wing assembly that can be, permanently or not, voluntarily partially deflected by an operator to avoid hitting rigid obstacles with the free end of the retractable side wing and/or limit the motion of the same within a partially and a fully deflected positions.

Yet a further object of the present invention is to provide a deflecting retractable side wing assembly that includes a resilient member at its free end to hit obstacles, when unavoidable, without damaging the free end of the side wing itself.

Other objects and advantages of the present invention will become apparent from a careful reading of the detailed description provided herein, with appropriate reference to the accompanying drawings.

SUMMARY OF THE INVENTION

According to one aspect of the present invention, there is provided a retractable side wing assembly adapted to be mounted on a side of a road vehicle for clearing snow off a road surface, said side wing assembly comprising a scraper having a frontward end pivotally secured to said side of said vehicle and a rearwardly and outwardly extending free end, a retracting member having a first end rotatably secured to a moving part of a shock absorbing device and a second end rotatably secured either to said side of said vehicle rearwardly of said scraper or to said scraper in proximity of said free end, and a fixed part of said shock absorbing device rigidly secured either to said scraper in proximity of said frontward end or to said vehicle rearwardly of said scraper respectively, said shock absorbing device including an absorber member rigidly secured to both said moving and fixed parts thereof, said shock absorbing device allowing for automatic rearward deflection of said scraper pivoting around said frontward end from a standard position to a fully deflected position when hitting an obstacle and said retracting member allowing for retracting and extracting said retractable assembly in up and down position along said side of said vehicle respectively.

Preferably, the moving part of said shock absorbing device is slidably secured to said fixed part.

Preferably, the said scraper, shock absorbing device and retracting member are generally laid within a same horizontal plane.

Preferably, the second end of said retracting member is rotatably secured to said side of said vehicle rearwardly of said scraper and said fixed part of said shock absorbing device being rigidly secured to said scraper in proximity of said frontward end, said moving part being generally rearwardly of and linearly moving relative to said fixed part in a direction generally parallel to said scraper.

Preferably, the shock absorbing device includes a guiding member for guiding said moving part slidably mounted on said fixed part.

Preferably, the moving part of said shock absorbing device is a carriage and said guiding member being at least one roller rotatably mounted on said carriage for rollingly engaging a corresponding guiding rail of said fixed part.

Preferably, the absorber member is a damping member, such as a typical pneumatic damping suspension.

Preferably, the retracting member and said scraper define within a generally horizontal plane an internal angle greater than 90 degrees.

Preferably, the shock absorbing device is a kit retrofitted on said scraper and retracting member, the latter two having been previously assembled together on said side of said vehicle.

Preferably, the retractable assembly further comprises a hydraulic ram actuator having a first extremity pivotally mounted to said free end of said scraper outwardly of said moving part of said shock absorbing device and a second extremity abutting said moving part, said actuator pushing said moving part toward said fixed part in a partially deflected position of said scraper when activated by an operator via a hydraulic network, thus limiting free automatic deflection of said scraper between said partially deflected and said fully deflected positions.

Preferably, the retractable assembly further comprises a resilient member secured to said free end of said scraper and slightly extending out of the same and adapted to take lateral hit instead of said free end to protect the same from lateral vertical obstacles.

Preferably, the resilient member includes at least one resilient roller made out of rubber type material and freely rotatably mounted on a generally vertical shaft rigidly supported by brackets secured to said free end of said scraper.

Alternatively, the second end of said retracting member being rotatably secured to said scraper in proximity of said free end of the same and said fixed part of said shock absorbing device being rigidly secured to said vehicle rearwardly of said scraper, said moving part being generally frontwardly of and linearly moving relative to said fixed part in a direction generally parallel to said side of said vehicle.

Accordingly, the retractable assembly preferably further comprises a hydraulic ram actuator having a first extremity pivotally mounted to said side of said vehicle frontwardly of said moving part of said shock absorbing device and a second extremity abutting said moving part, said actuator pushing said moving part toward said fixed part in a partially deflected position of said scraper when activated by an operator via a hydraulic network, thus limiting free automatic deflection of said scraper between said partially deflected and said fully deflected positions.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
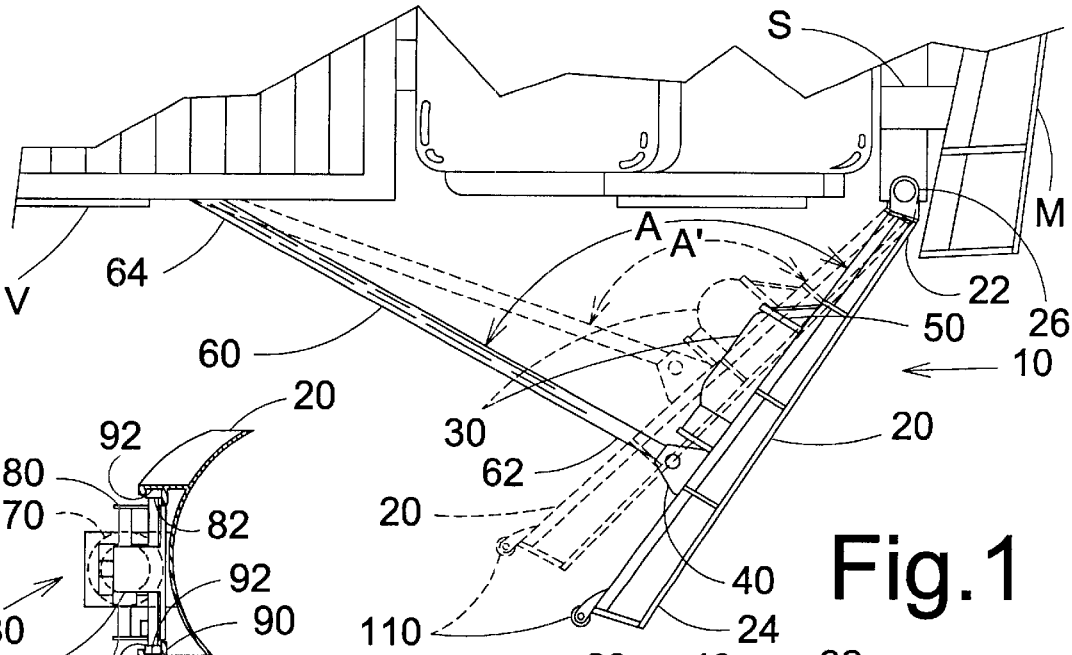
FIG. 1 is a broken top plan view of an embodiment of a retractable side wing assembly in accordance to the present invention mounted on a road vehicle such as a snow plow, showing the side wing in a standard position and a fully deflected position in solid and dashed lines respectively.
Figure 6:
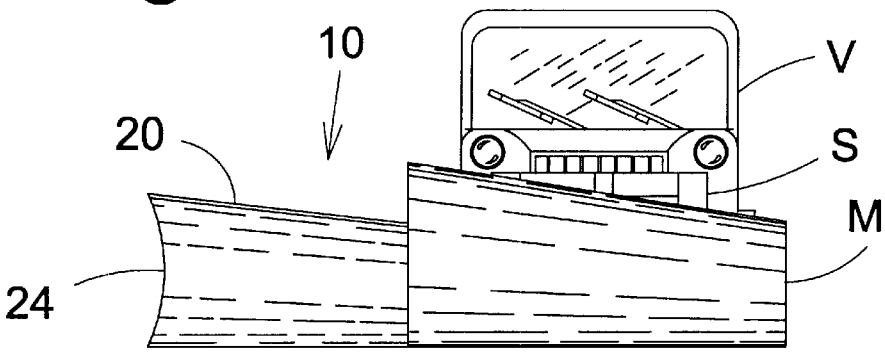
FIGS. 6 and 7 are front views of the embodiment of FIG. 1 showing the side wing assembly in the extracted (in use) and retracted position respectively.
Figure 7:
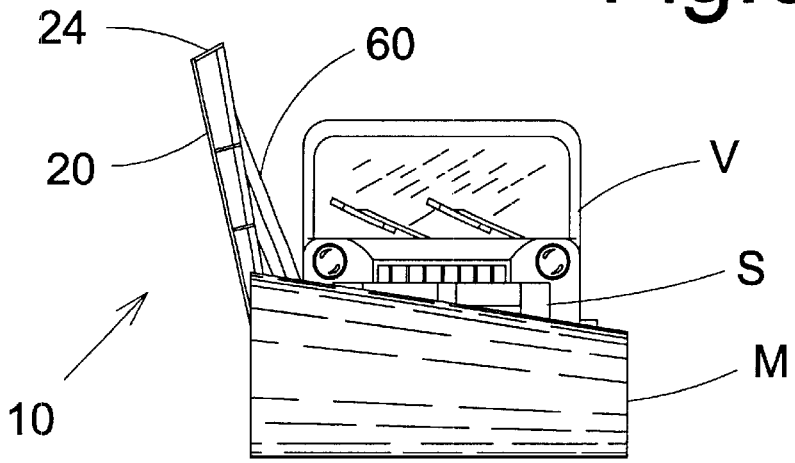

Referring to FIG. 1, there is shown an embodiment 10 of a retractable side wing assembly according to the present invention mounted on the side of a road vehicle V, such as a snow plow or the like, preferably for increasing the working span of a main front scraper M supported by its supporting structure S to clear the snow off the road surface. The side wing assembly 10 comprises a scraper 20 having a frontward end 22 pivotally secured to the side of the vehicle V, preferably to the supporting structure S. The scraper 20 rearwardly and outwardly extends from the side of the vehicle V down to a free end 24. The assembly 10 includes a shock absorbing device 30 generally longitudinally and rigidly mounted to the back side of the scraper 20, and a retracting member 60 for extracting and retracting the assembly 10 down to and up from its standard operating position as shown in FIGS. 6 and 7 respectively, in which the scraper 20, the shock absorbing device 30 and the retracting member 60 are all preferably laid within a same horizontal plane. The retracting member 60 is preferably rotatably secured to a moving part 40 of the shock absorbing device 30 and rotatably secured to the side of the vehicle V rearwardly of the frontward end 22 of the scraper 20 at a second end 64.

Figure 4:
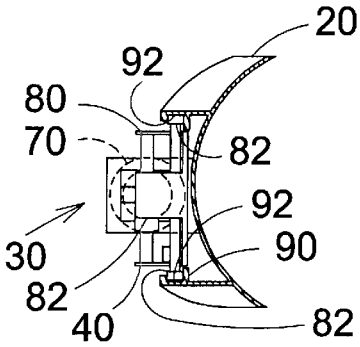
FIG. 4 is a section view taken along line 4—4 of FIG. 3.
Figure 2:
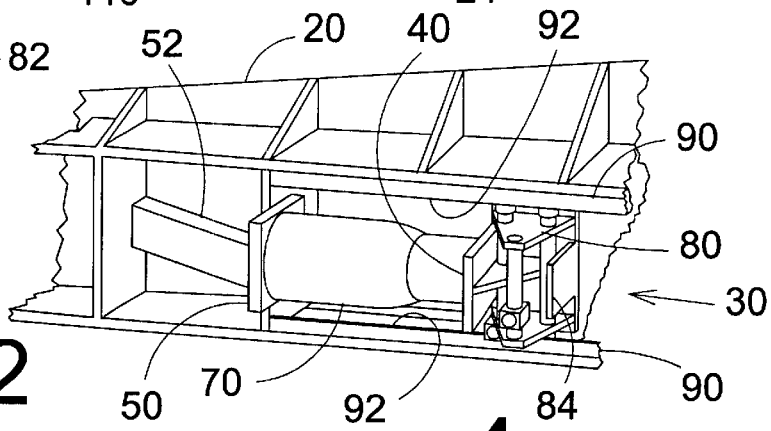
FIG. 2 is a partial enlarged perspective view of the shock absorbing device of the embodiment of FIG. 1 mounted on the back of the side wing.
Figure 3:
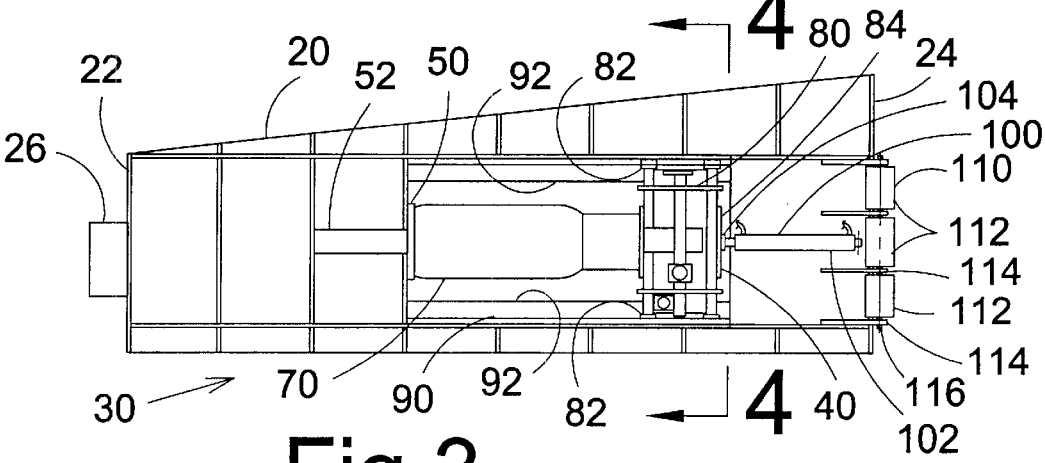
FIG. 3 is a back view of the side wing scraper of the embodiment of FIG. 1.

As shown in FIG. 2, the shock absorbing device 30 preferably includes an absorber member 70, preferably a damping member such as a typical pneumatic suspension used in heavy load road vehicles or any other pneumatic or hydraulic linear actuator, secured to both a carriage 80 of the moving part 40 and the fixed part 50 of the shock absorbing device 30, itself rigidly secured to the back of the scraper 20, in proximity of its frontward end 22. Preferably, the carriage 80 is slidably secured to the fixed part 50 via a guiding member 90. The latter preferably includes a pair of guiding rails 92 secured to the fixed part 50 and adapted to be rollingly engaged by corresponding rollers 82 rotatably mounted to the carriage 80, as shown in FIGS. 2, 3 and 4. Alternatively, the guiding member 90 could be simple Teflon® based linear mounting bearings (not shown) sliding along the rails 92.

Although not recommended, the damping mechanism 70 could also include a coil spring member as long as its response to an impact is quick enough.

Figure 5:
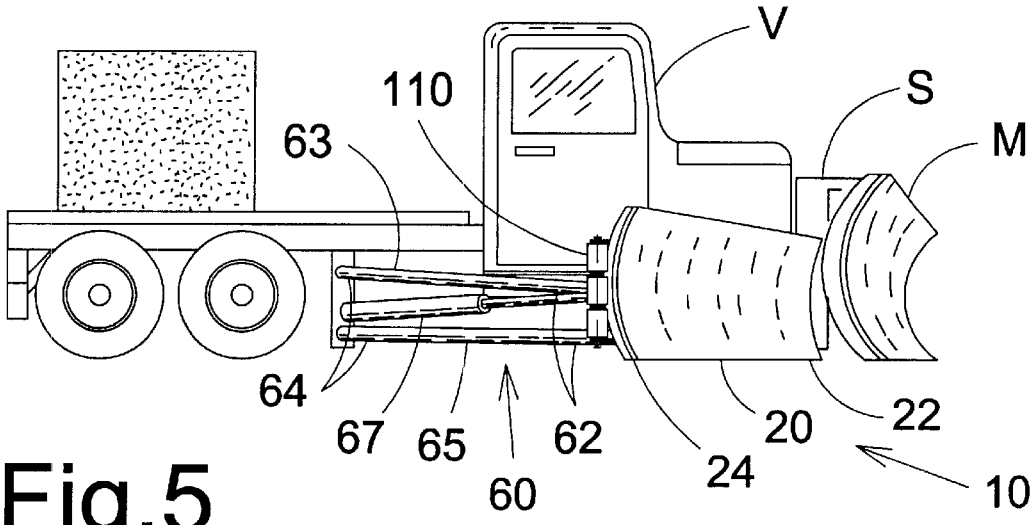
FIG. 5 is a side view of the embodiment of FIG. 1.

As illustrated in FIG. 5, the typical retracting member 60 has an upper 63 and a lower tie-bars 65 located parallel one above the other between first 62 and second 64 ends of the retracting member 60 and pivotally connected to the same, and a hydraulic ram 67 diagonally and pivotally attached to first 62 and second 64 ends in between tie-bars 63 and 65.

As shown in FIGS. 1 and 3, the frontward end 22 of the scraper 20 preferably has a spherical socket joint 26 for pivotally connecting the same to the supporting structure S of the main plow M. Referring to FIG. 2, the fixed part 50 of the shock absorbing device 30 preferably includes a reinforcing brace 52 secured to the scraper 20.

As illustrated in FIG. 1, the internal angle A in standard position between the retracting member 60 and the scraper 20 is preferably greater than 90 degrees in order to ensure a better compression of the absorber member 70 when the scraper 20 hits an obstacle O that is either on the road surface or on the side of the road. The same angle A increases and becomes A' when the scraper 20 is in its fully deflected position, as shown in dashed lines.

Referring to the FIG. 3, the assembly 10 preferably includes a hydraulic ram actuator 100 for abutting and pushing the carriage 80 toward the fixed part 50 whenever desired by an operator of the vehicle via a hydraulic network (not shown). The carriage 80 can be pushed at any position such that the scraper 20 would be limited to move between the partially deflected selected position set by the operator and its fully deflected position. The actuator 100 has its cylinder extremity 102 pivotally secured to the free end 24 of the scraper 20 and its piston extremity 104 adapted to abut an abutment plate 84 of the carriage 80. When the piston extremity 104 is fully retracted inside the cylinder extremity 102, the scraper 20 of the side wing assembly 10 is allowed to go back in its standard position under the action of the shock absorbing device 30 not being compressed by any obstacle O.

Optionally, as shown in FIGS. 1, 3 and 5, the assembly 10 includes a resilient member 110 secured to the free end 24 of the scraper 20 and slightly extending out of the same and adapted to take any lateral hit instead of the free end 24 to protect the same. The resilient member 110 is formed of at least one, preferably three resilient rollers 112 freely rotatably mounted on a same generally vertical shaft 116 rigidly supported by brackets 114. The rollers 112, preferably made out of rubber type material, Teflon® and the like materials, are generally protruding out of the lower portion of the free end 24 of the scraper 20.

Figure 8:
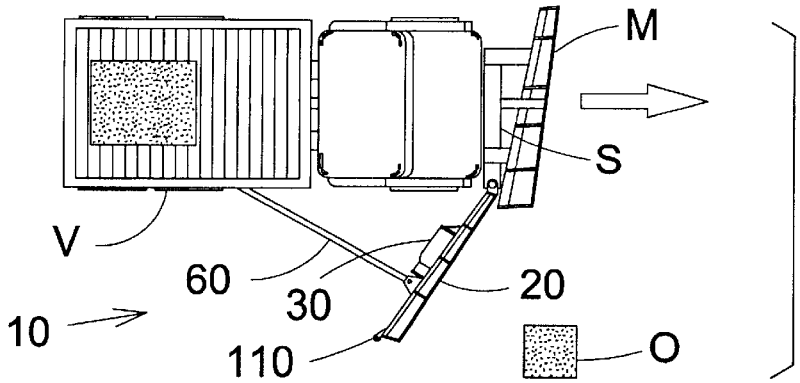
FIG. 8 is a top plan view of the embodiment of FIG. 1 before getting into contact with an obstacle.
Figure 9:
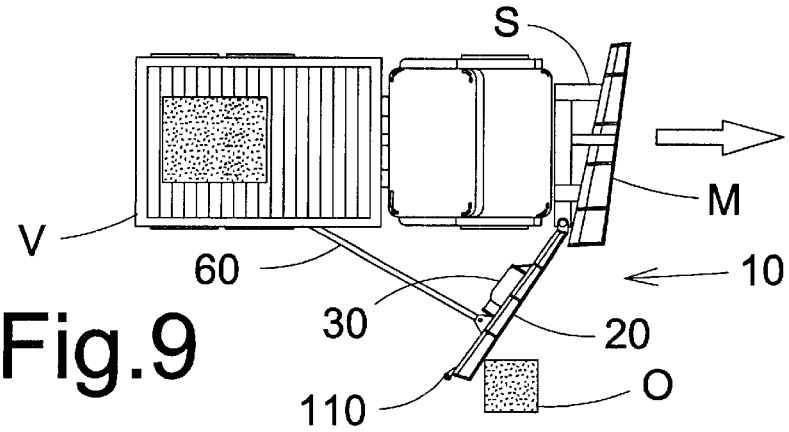
FIG. 9 is a top plan view of the embodiment of FIG. 1 getting into contact with the obstacle, but still in the standard position.
Figure 10:
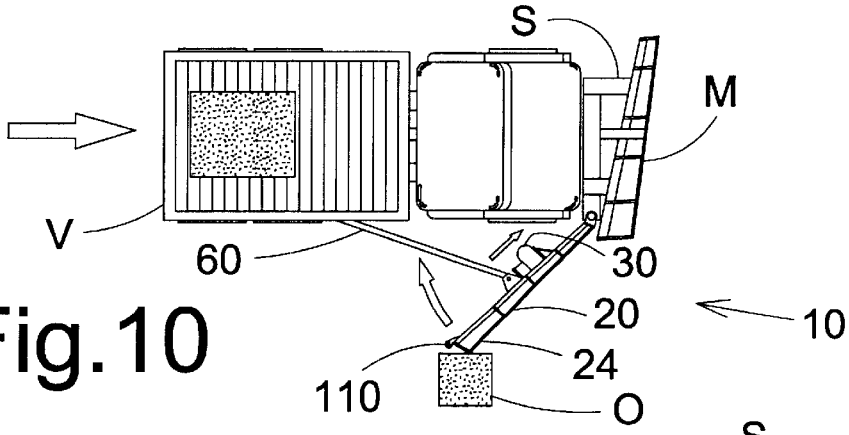
FIG. 10 is a top plan view of the embodiment of FIG. 1 being automatically deflected under contact with the obstacle.
Figure 11:
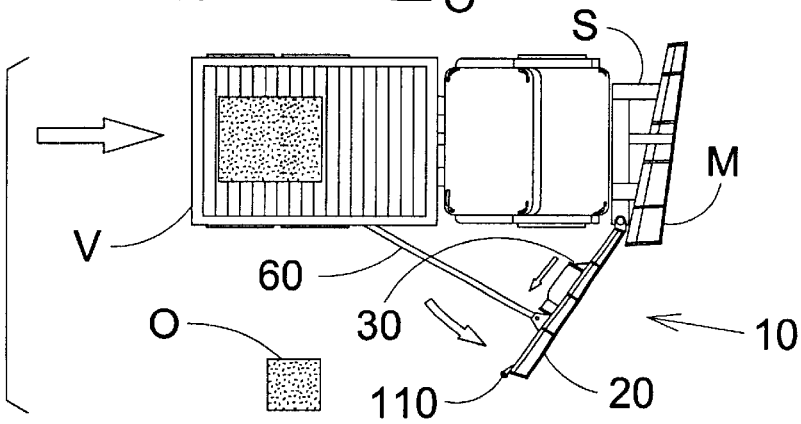
FIG. 11 is a top plan view of the embodiment of FIG. 1 back in the standard position after the scraper has passed the obstacle.

Referring to FIGS. 8 to 11, there are shown sequential positions of the deflecting retractable side wing assembly 10 of the present invention installed on the side of the vehicle V entering in contact with a lateral obstacle O. Before the impact between the side scraper 20 and the obstacle O, the side wing assembly 10 is in its standard operating position, as shown in FIG. 8. Because of the impact between the protruding resilient rollers 112 of the side scraper 20 and the obstacle O, as shown in FIGS. 9 and 10, the side scraper 20 is pushed to rotate around the socket joint 26 and will, at the same time, compress the absorber member 70 of the shock absorbing device 30 to have the scraper 20 moving from its standard un-deflected position (FIG. 9) to its fully deflected position (FIG. 10 and also FIG. 1 in dashed lines) of the retractable side wing assembly 10, thus forcing the sliding movement of the carriage 80 along the fixed part 50, while inducing a slight pressure on the retracting member 60. Following the impact, as shown in FIG. 11, the shock absorbing device 30 reposition the retractable side wing assembly 10 back in its standard position, with the scraper 20 not damaged by the obstacle O.

The embodiment 10 illustrated in FIGS. 1 to 11 can be easily retrofitted as a kit on existing retractable side wing assemblies, preferably at the back side of the scrapers 20, to make them deflecting upon hitting any obstacle O, without any major modification of any existing parts such as the scraper 20 and the retracting means 60.

Figure 12:
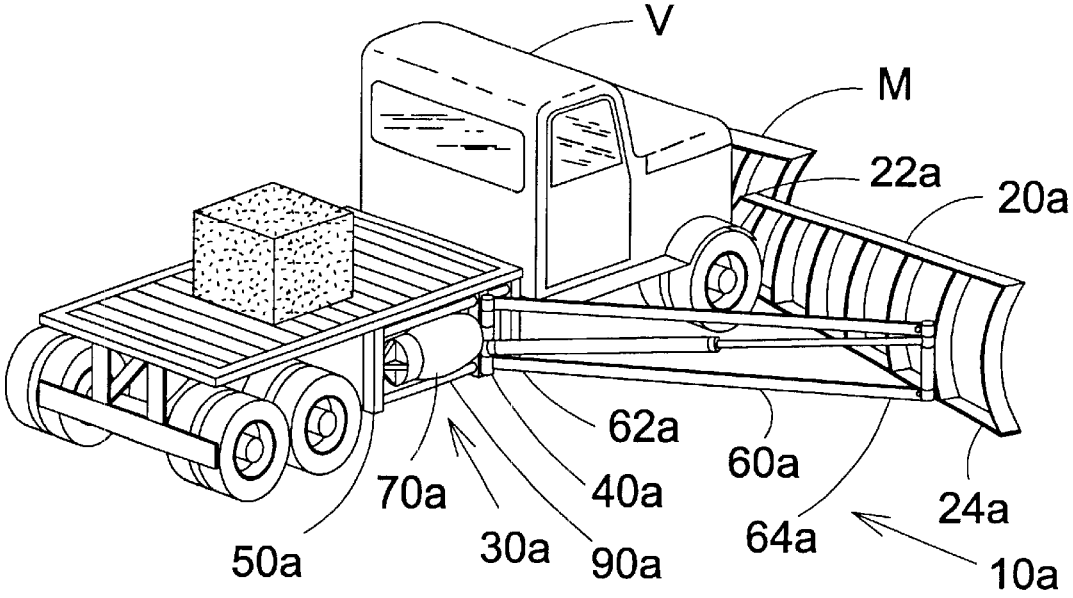
FIG. 12 is a perspective view of another embodiment of a retractable side wing assembly in accordance to the present invention showing the shock absorbing device mounted along the side of the road vehicle.
Figure 13:
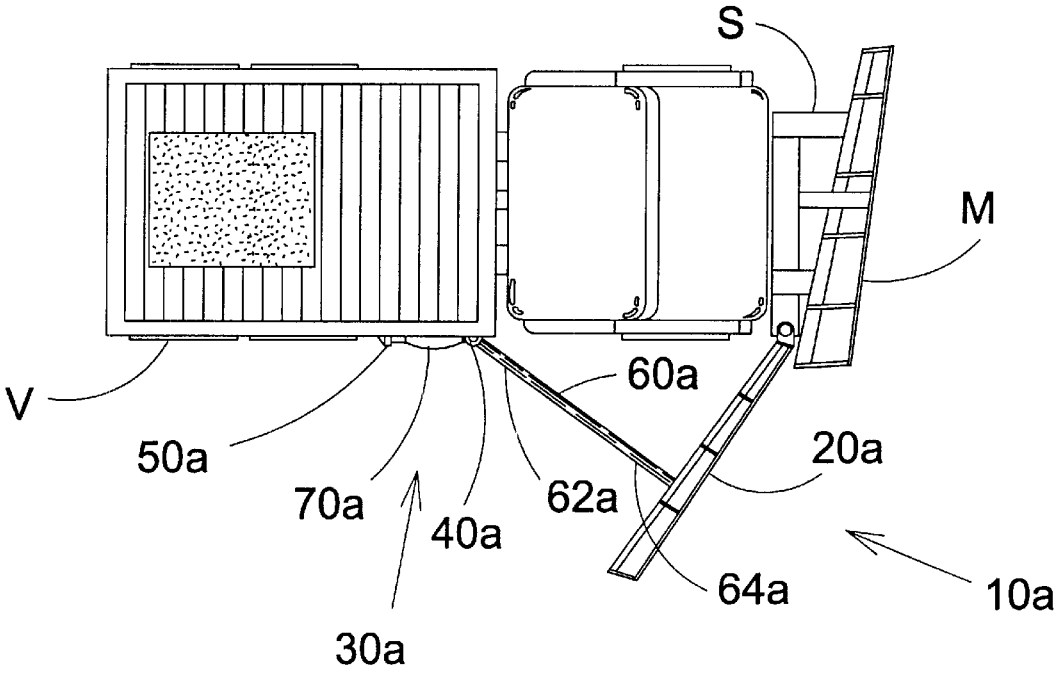
FIG. 13 is a top plan view of the embodiment of FIG. 12.

As it illustrated in FIGS. 12 and 13, in another embodiment 10*a* of a retractable side wing assembly in accordance with the present invention, the shock absorbing device 30*a* can be located along the side of the vehicle V, rearwardly of the frontward end 22*a* of the scraper 20*a*. The moving part 40*a* of the shock absorbing device 30*a* rotatably secured to the retracting member 60*a* is obviously located frontward relative to the fixed end 50*a* and sliding on the same following the guiding means 90*a*.

Although embodiments have been described herein with some particularities and details, many modifications and variations of the preferred embodiments are possible without deviating from the scope of the present invention.

I claim:

1. A retractable side wing assembly adapted to be mounted on a side of a road vehicle for clearing snow off a road surface, said side wing assembly comprising a scraper having a frontward end pivotally secured to said side of said vehicle and a rearwardly and outwardly extending free end, a retracting member having a first end rotatably secured to a moving part of a shock absorbing device and a second end rotatably secured either to said side of said vehicle rearwardly of said scraper or to said scraper in proximity of said free end, and a fixed part of said shock absorbing device rigidly secured either to said scraper in proximity of said frontward end or to said vehicle rearwardly of said scraper respectively, said shock absorbing device including an absorber member rigidly secured to both said moving and fixed parts thereof, said shock absorbing device allowing for automatic rearward deflection of said scraper pivoting around said frontward end from a standard position to a deflected position when hitting an obstacle and said retracting member allowing for retracting and extracting said retractable assembly said in an up and down position along said side of said vehicle respectively.

2. A retractable assembly as defined in claim 1, wherein said moving part of said shock absorbing device being slidably secured to said fixed part.

3. A retractable assembly as defined in claim 1, wherein said scraper, said shock absorbing device and said retracting member being generally laid within a same horizontal plane.

4. A retractable assembly as defined in claim 2, wherein said second end of said retracting member being rotatably secured to said side of said vehicle rearwardly of said scraper and said fixed part of said shock absorbing device being rigidly secured to said scraper in proximity of said frontward end, said moving part being generally rearwardly of and linearly moving relative to said fixed part in a direction generally parallel to said scraper.

5. A retractable assembly as defined in claim 2, wherein said second end of said retracting member being rotatably secured to said scraper in proximity of said free end of the same and said fixed part of said shock absorbing device being rigidly secured to said vehicle rearwardly of said scraper, said moving part being generally frontwardly of and linearly moving relative to said fixed part in a direction generally parallel to said side of said vehicle.

6. A retractable assembly as defined in claim 2, wherein said shock absorbing device including a guiding member for guiding said moving part slidably mounted on said fixed part.

7. A retractable assembly as defined in claim 6, wherein said moving part of said shock absorbing device being a carriage and said guiding member being at least one roller rotatably mounted on said carriage for rollingly engaging a corresponding guiding rail of said fixed part.

8. A retractable assembly as defined in claim 2, wherein said absorber member being a damping member.

9. A retractable assembly as defined in claim 8, wherein said damping member being a pneumatic linear actuator.

10. A retractable assembly as defined in claim 8, wherein said damping member being a typical pneumatic damping suspension.

11. A retractable assembly as defined in claim 1, wherein said shock absorbing device being a kit retrofitted on said scraper and retracting member, the latter two having been previously assembled together on said side of said vehicle.

12. A retractable assembly as defined in claim 4, wherein said retracting member and said scraper defining within a generally horizontal plane an internal angle greater than 90 degrees.

13. A retractable assembly as defined in claim 4, further comprising a hydraulic ram actuator having a first extremity pivotally mounted to said free end of said scraper outwardly of said moving part of said shock absorbing device and a second extremity abutting said moving part, said actuator pushing said moving part toward said fixed part in a partially deflected position of said scraper when activated by an operator via a hydraulic network, thus limiting free automatic deflection of said scraper between said partially deflected and said fully deflected positions.

14. A retractable assembly as defined in claim 5, further comprising a hydraulic ram actuator having a first extremity pivotally mounted to said side of said vehicle frontwardly of said moving part of said shock absorbing device and a second extremity abutting said moving part, said actuator pushing said moving part toward said fixed part in a partially deflected position of said scraper when activated by an operator via a hydraulic network, thus limiting free automatic deflection of said scraper between said partially deflected and said fully deflected positions.

15. A retractable assembly as defined in claim 1, further comprising a resilient member secured to said free end of said scraper and slightly extending out of the same and adapted to take a lateral hit instead of said free end to protect the same from lateral vertical obstacles.

16. A retractable assembly as defined in claim 15, wherein said resilient member including at least one resilient roller freely rotatably mounted on a generally vertical shaft rigidly supported by brackets secured to said free end of said scraper.

17. A retractable assembly as defined in claim 16, wherein said at least one resilient roller being made out of rubber type material.

18. A retractable assembly as defined in claim 12, further comprising a resilient member secured to said free end of said scraper and slightly extending out of the same and adapted to take a lateral hit instead of said free end to protect the same from lateral vertical obstacles.

19. A retractable assembly as defined in claim 18, wherein said resilient member including at least one resilient roller freely rotatably mounted on a generally vertical shaft rigidly supported by brackets secured to said free end of said scraper.

20. A retractable assembly as defined in claim 19, wherein said at least one resilient roller being made out of rubber type material.

* * * * *